US006884149B2

(12) United States Patent
Tsai et al.

(10) Patent No.: US 6,884,149 B2
(45) Date of Patent: Apr. 26, 2005

(54) METHOD AND SYSTEM FOR IN-SITU MONITORING OF MIXING RATIO OF HIGH SELECTIVITY SLURRY

(75) Inventors: Shang-Ting Tsai, Taipei (TW); Ping Chuang, Taichung (TW); Henry Lo, Hsinchu (TW); Chao-Jung Chang, Yunghe (TW); Ping-Hsu Chen, Taichung (TW); Yu-Liang Lin, Hsin-Chu (TW); Yu-Huei Chen, Taipei (TW); Ai-Sen Liu, Hsinchu (TW); Syun-Ming Jang, Hsin-Chu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 10/833,720

(22) Filed: Apr. 27, 2004

(65) Prior Publication Data

US 2004/0203322 A1 Oct. 14, 2004

Related U.S. Application Data

(62) Division of application No. 10/170,674, filed on Jun. 13, 2002, now Pat. No. 6,729,935.

(51) Int. Cl.[7] ..... B24B 1/00

(52) U.S. Cl. ..... 451/6; 451/8; 451/53; 156/345.13; 156/345.15

(58) Field of Search ..... 451/8, 6, 36, 53; 438/693; 156/345.12, 345.13, 345.15, 345.24

(56) References Cited

U.S. PATENT DOCUMENTS

| | | | | |
|---|---|---|---|---|
| 5,191,388 A | * | 3/1993 | Kilham | 356/335 |
| 5,619,043 A | * | 4/1997 | Preikschat et al. | 250/574 |
| 5,962,343 A | * | 10/1999 | Kasai et al. | 438/693 |
| 6,296,548 B1 | * | 10/2001 | Wiswesser et al. | 451/8 |
| 6,572,964 B2 | * | 6/2003 | Tanaka et al. | 428/328 |

* cited by examiner

*Primary Examiner*—Eileen P. Morgan
(74) *Attorney, Agent, or Firm*—Tung & Associates

(57) ABSTRACT

A method and system for monitoring the quality of a slurry utilized in a chemical mechanical polishing operation. A slurry is generally delivered through a tubular path during a chemical mechanical polishing operation. A laser light is generally transmitted from a laser light source, such that the laser light comes into contact with the slurry during the chemical mechanical polishing operation. The laser light can then be detected, after the laser light comes into contact with the slurry to thereby monitor the quality of the slurry utilized during the chemical mechanical polishing operation. The laser light that comes into contact with the slurry can be also be utilized to monitor a mixing ratio associated with the slurry.

8 Claims, 4 Drawing Sheets

METHOD AND SYSTEM FOR IN-SITU MONITORING OF MIXING RATIO OF HIGH SELECTIVITY SLURRY

This is a divisional of application Ser. No. 10/170,674 filed on Jun. 13, 2002 now U.S. Pat. No. 6,729,935.

TECHNICAL FIELD

The present invention relates generally to semiconductor fabrication methods and systems. The present invention also generally relates to chemical mechanical polishing (CMP) devices and techniques thereof. The present invention additionally relates to techniques and systems thereof for monitoring the quality of slurries utilized in CMP operations.

BACKGROUND OF THE INVENTION

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques used to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar, outer surface, whether conductive, semiconductive, or insulative, to form a relatively flat, smooth surface. Following planarization, additional layers may be deposited on the outer surface to form interconnect lines between features, or the outer surface may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the finish (roughness) and flatness (lack of large scale topography) of the substrate surface, and the polishing rate. Inadequate flatness and finish can produce substrate defects. The polishing rate sets the time needed to polish a layer. Thus, it sets the maximum throughput of the polishing apparatus.

Each polishing pad provides a surface, which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

The mixing ratio of a slurry utilized in a chemical mechanical polishing operation is extremely sensitive in the performance of a slurry. Thus, it is important to be able to monitor the quality of a slurry, and hence, its associated mixing ratio, prior, during and after a polishing operation. This is particularly true with high selectivity slurries. The lack of in-situ slurry monitoring techniques usually results in unstable and inconsistence slurry polishing performances. The present inventors have thus concluded, based on the foregoing, that a need exists for a method and system for reliably monitoring the mixing-ratio of a slurry utilized in a chemical mechanical polishing operation.

BRIEF SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole.

It is therefore one aspect of the present invention to provide an improved semiconductor fabrication method and system.

It is therefore another aspect of the present invention to provide an improved chemical mechanical polishing (CMP) method and system utilized in semiconductor fabrication operations.

It is still another aspect of the present invention to provide a method and system for in-situ monitoring of the quality of a slurry utilized in a chemical mechanical polishing (CMP) operation.

It is yet another aspect of the present invention to provide a method and system for in-situ monitoring of the mixing ratio of a slurry utilized in a chemical mechanical polishing operation.

The above and other aspects of the present invention can thus be achieved as is now described. A method and system for monitoring the quality of a slurry utilized in a chemical mechanical polishing operation is disclosed herein. A slurry is generally delivered through a tubular path during a chemical mechanical polishing operation. A laser light is generally transmitted from a laser light source, such that the laser light comes into contact with the slurry during the chemical mechanical polishing operation. The laser light can then be detected, after the laser light comes into contact with the slurry to thereby monitor the quality of the slurry utilized during the chemical mechanical polishing operation. The laser light that comes into contact with the slurry can be also be utilized to monitor a mixing ratio associated with the slurry. The laser light source may be integrated with a chemical mechanical polisher utilized during the chemical mechanical polishing operation. The laser light may comprise a fixed-wavelength laser light source.

The laser light may pass through an optical component after the last light comes into contact with the slurry. Thereafter, the laser light may be focused on a diffraction grating and thereby detected utilizing at least one spectrometer thereof. The tubular path through which the slurry flows may comprise a window located on a slurry line utilized in the chemical mechanical polishing operation. A rate of removal of the slurry may be predicted utilizing data associated with the laser light, after the laser light comes into contact with the slurry.

An alternative method and system for monitoring a mixing ratio of a mixture utilized in a chemical mechanical polishing operation is also disclosed herein. In such an alternative method and system, an abrasive component may be combined with an additive component to form a mixture thereof, wherein the mixture comprises a particular ultraviolet absorption spectra. The abrasive component and additive component may thereafter be diluted. Next, the particular ultraviolet absorption spectra may be analyzed such that the particular ultraviolet absorption spectra reflects a concentration of each component comprising the mixture, thereby providing data thereof indicative of the mixing ratio of the mixture utilized in the chemical mechanical polishing operation. A calibration curve can be established based on a known mixing ration mixture (e.g., 2:1, 1:1, 1:2, 1:3, etc). A concentration of each component (i.e., abrasive and additive) can be estimated from the calibration curve. The mixture generally comprises a slurry utilized in the chemical mechanical polishing operation. The abrasive component may be combined with the additive component in-line to form the mixture (i.e., slurry) thereof.

BRIEF DESCRIPTION OF THE DRAWINGS

The accompanying figures, in which like reference numerals refer to identical or functionally-similar elements throughout the separate views and which are incorporated in and form part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate embodiments of the present invention and are not intended to limit the scope of the invention.

Figure 1:
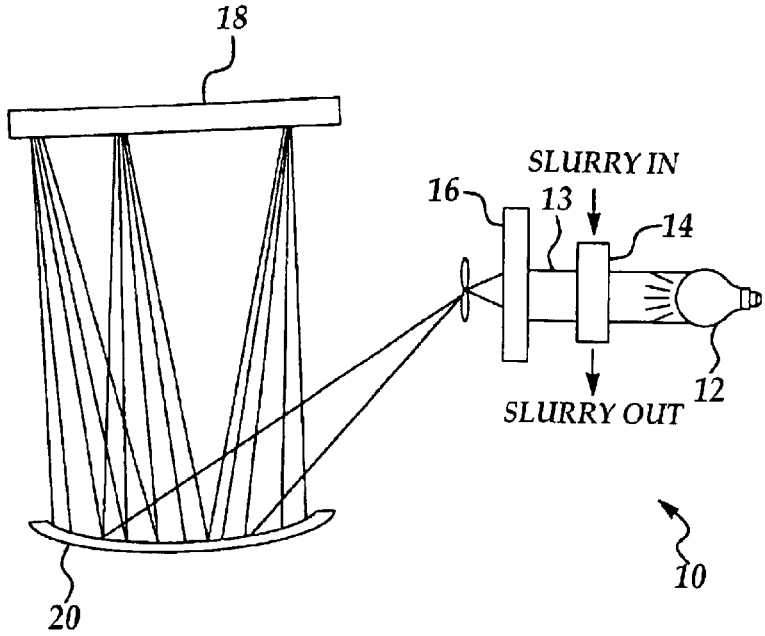
FIG. 1 depicts a block diagram illustrating a system for in-situ monitoring of a mixing ratio associated with a high selectivity slurry utilized in a chemical mechanical polishing operation, in accordance with a preferred embodiment of the present invention.

FIG. 1 depicts a block diagram illustrating a system 10 for in-situ monitoring of a mixing ratio associated with a high selectivity slurry utilized in a chemical mechanical polishing (CMP) operation, in accordance with a preferred embodiment of the present invention. Because the mixing ratio of a mixture (e.g., a slurry) utilized in CMP operations is extremely sensitivity to the performance of the mixture, it is advantageous to be able to monitor in-situ, the mixing ratio of such a mixture, particularly a high selectivity slurry. System 10 thus comprises a laser light source 12, which can be configured as a fixed wavelength laser source for monitoring the mixing ratio of a slurry composed of more than two components. Laser light source can be integrated with any CMP tool and system thereof. Due to unique characteristics of increased response and lower intensity decay that other light sources, small variations of mixing ratio can be easily detected utilizing system 10.

System 10 additionally includes a window 14 through which a slurry may enter and exit (i.e., "slurry in" and "slurry out"). Window 14 is generally located on a slurry line 13. Laser light transmitted from laser light source 12 thus comes into contact with a slurry that enters and exits through window 14. After the laser light comes into contact with the slurry, the laser light then passes through an optical component 16. Optical component 16 focuses the laser light on a diffraction grating 16. The laser light can then be detected utilizing a spectrometer 18.

The block diagram illustrated in FIG. 1 thus generally indicates a method and system for monitoring the quality of slurry utilized in a chemical mechanical polishing operation. The slurry can generally be delivered through a tubular path (i.e., window 14) during a CMP operation. Laser light transmitted from a laser light source (i.e., laser light source 12) comes into contact with slurry during the CMP operation. The laser light can be detected after it comes into contact with the slurry, thereby permitting the quality of the slurry, and additionally, the mixing ratio, to be successfully monitored during a CMP operation.

A number of benefits can accrue in response to implementing the system 10 illustrated in FIG. 1. For example, system 10 comprises a less complex design providing an increased economic retrofit for older CMP tools and techniques thereof. Additionally, system 10 is configured on-line, thus providing continuous monitoring of undiluted slurry. Also, no local display is required. A trigger alarm can also be implemented for out-of-spec conditions. The slurry removal rate and selectivity, as wells as the endpoint time, can also be predicted by implementing system 10. Finally, CMP process throughput can be effectively improved through an implementation of system 10.

System 10 illustrated in FIG. 1 generally functions based on the fact that non-adsorption particles decrease light intensity by scattering. This general principle can be expressed by turbidity:

$$I=I_o e^{-\lambda L}$$

Where,

I=transmitted intensity $I_o$=initial intensity

ë=turbidity (extinction coefficient)

L=length of light path.

Transmission can be expressed according to the following mathematical representation:

$$T\ (\%) = \frac{I}{I_O} = e^{-\lambda L}$$

Additionally, the ratio of extinction coefficient can be expressed by the following mathematical formulation:

$$\lambda_1/\lambda_2 = \ln(T_1)/\ln(T_2)$$

Figure 2:
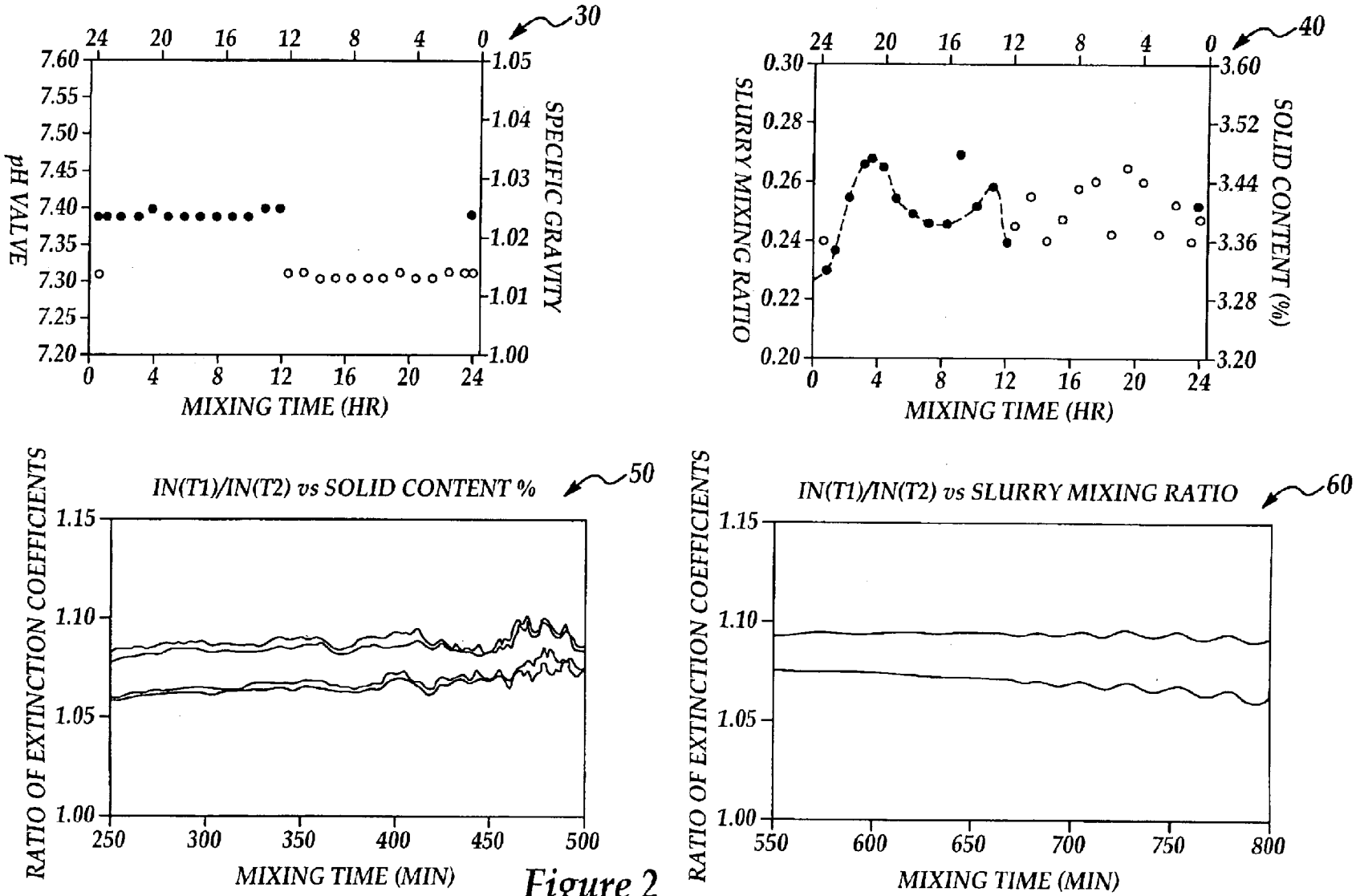
FIG. 2 illustrates a plurality of graphs indicating data that may be obtained through an implementation of the in-situ monitoring system illustrated in FIG. 1, in accordance with a preferred embodiment of the present invention.

FIG. 2 illustrates a plurality of graphs 30, 40, 50 and 60 indicating data that may be obtained through an implementation of the in-situ monitoring system illustrated in FIG. 1, in accordance with a preferred embodiment of the present invention. Graph 30 generally represents a plot of pH value versus mixing time (hour). Graph 40 generally represents a plot of a slurry-mixing ratio versus mixing time (hour). Graph 50 generally represents a plot of a ratio of extinction coefficients versus mixing time (minutes). Graph 50 indicates In (T1)/In (T2) versus a solid content percentage. Finally, graph 60 generally represents a plot of a ratio of extinction coefficients versus mixing time (minutes). Graph 50 generally indicates In (T1)/In (T2) versus a slurry mixing ratio.

Figure 3:
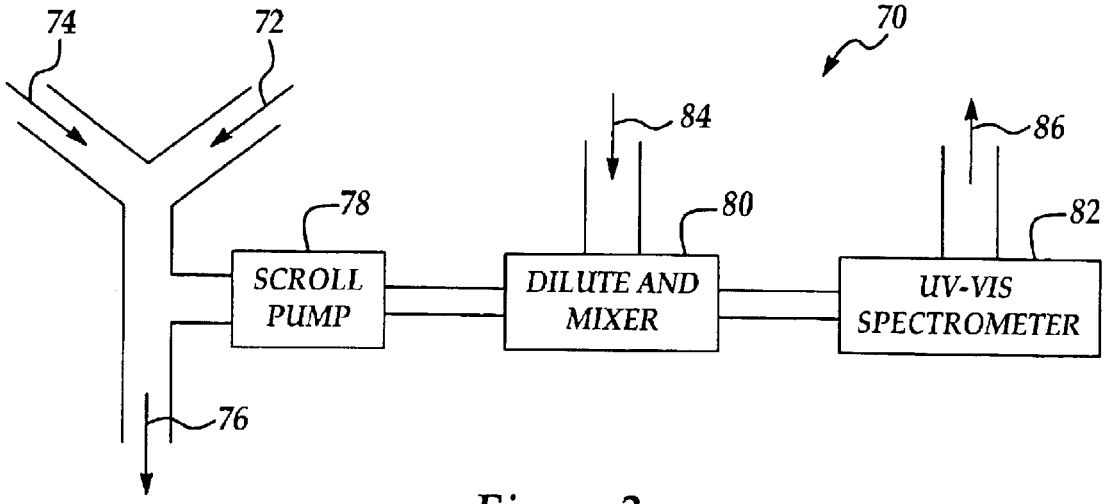
FIG. 3 depicts a block diagram illustrating a system for monitoring a CMP slurry-mixing ratio, in accordance with an alternative embodiment of the present invention.

FIG. 3 depicts a block diagram illustrating a system 70 for monitoring a CMP slurry-mixing ratio, in accordance with an alternative embodiment of the present invention. CMP slurry mixing is generally a very unstable process. It is difficult to monitor the concentration of each component in a slurry. System 70 thus overcomes the inherent unstable nature of CMP slurry mixing by monitoring a slurry mixing ration in-line and off-line by UV spectrum techniques. Associated UV spectrum data can be utilized to monitor the mixing ratio of a slurry with more than two components. UV adsorption can reflect the concentration of each component and ensure measurable CMP slurry mixing ratios.

Thus, as illustrated in FIG. 3, an abrasive component 74 may be combined with an additive component 72 to form a mixture 76 thereof, wherein mixture 76 comprises a particular ultraviolet (UV) absorption spectra. A scroll pump 78 can be utilized to pump mixture 76 into a chamber 80. A dilute component 84 can be added to chamber 80 and mixture 76 to dilute the abrasive component 74 and the additive component 72 of mixture 76. Dilute component 84 can, for example, be composed of a 1/500 dilution.

Mixture 76 and its particular components can thus be diluted in chamber 80 according to an application of Beer's law. Thereafter, the particular ultraviolet absorption spectra of mixture 76 can be analyzed utilizing a UV-VIS spectrometer 82, wherein said particular ultraviolet absorption spectra reflects a concentration of each component comprising mixture 76, thereby providing data thereof indicative of said mixing ratio of mixture 76 utilized in a CMP operation. A remaining solution or mixture can then be drained from spectrometer 82, as indicated by arrow 76.

The UV absorption of mixture 76 is essentially the linear combination of the UV spectra of abrasive 74 and additive 72. A calibration curve may be established based on a known mixing ratio mixture (e.g., 2:1, 1:1, 1:2, 1:3, etc). A concentration of abrasive component 74 and additive component 72 can then be estimated from the calibration curve. Mixture 76 generally comprises a slurry utilized in the CMP operation. Abrasive component 74 can be combined with additive component 72 in-line to form mixture 76 thereof. Such a combination can occur in-line (i.e., during polishing), but also via closed loop control (CLC) to feedback control operations. The UV technique described above can thus be utilized to measure an additive component (e.g., solid content) and abrasive component simultaneously.

Figure 4:
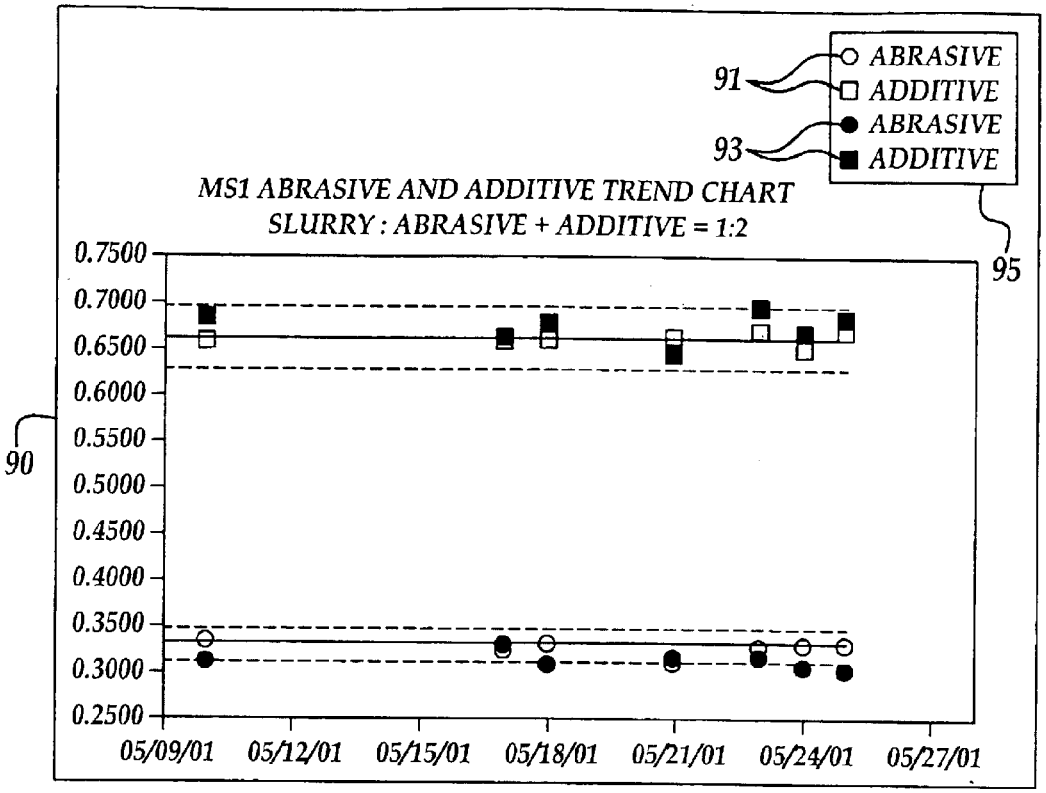
FIG. 4 illustrates a graph illustrating an abrasive and additive trend chart, in accordance with an alternative embodiment of the present invention.
Figure 5:
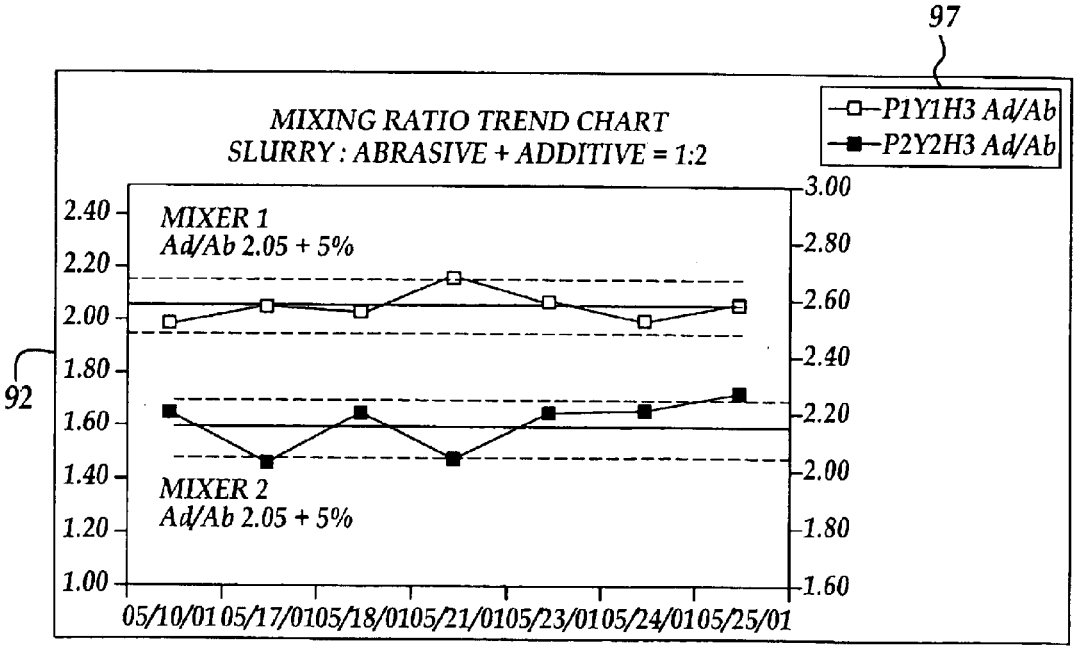
FIG. 5 depicts a graph illustrating a mixing ratio trend chart, in accordance with an alternative embodiment of the present invention.
Figure 6:
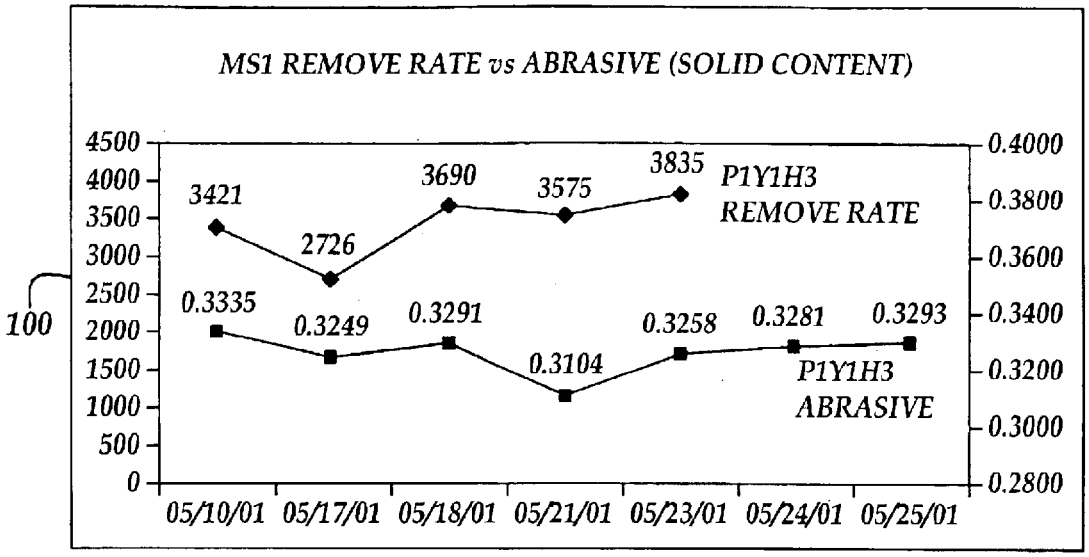
FIG. 6 illustrates a graph illustrating a removal rate versus abrasive (solid content), in accordance with an alternative embodiment of the present invention.
Figure 7:
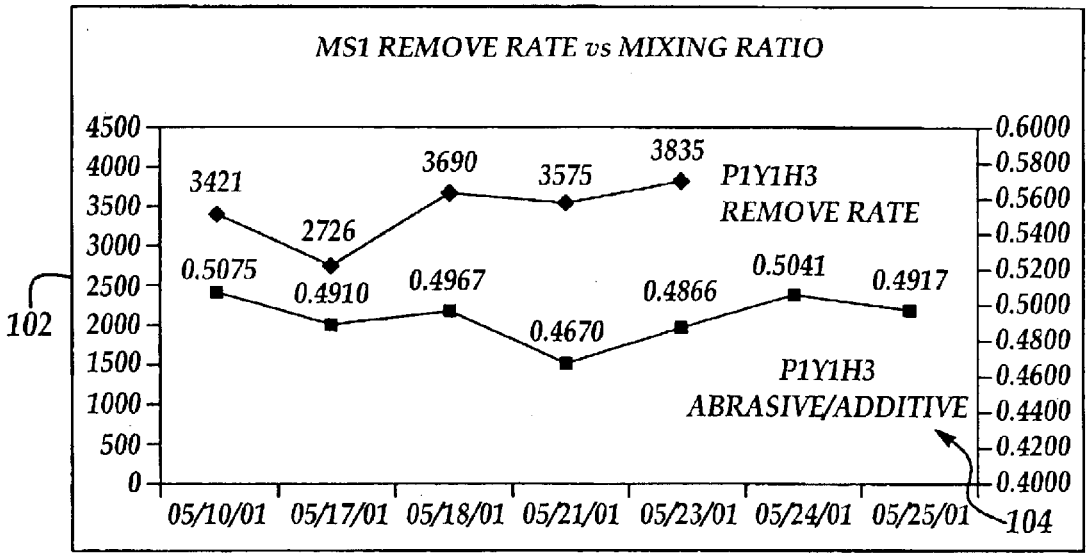
FIG. 7 depicts a graph illustrating a removal rate versus mixing ratio, in accordance with an alternative embodiment of the present invention.

FIG. 4 illustrates a graph 90 illustrating an abrasive and additive trend chart, in accordance with an alternative embodiment of the present invention. Graph 90 includes a legend 95, which indicates a first mixer legend 91 and second mixer legend 93. FIG. 5 depicts a graph 92 illustrating a mixing ratio trend chart, in accordance with an alternative embodiment of the present invention. Legend 97 of graph 92 indicates plotting shapes utilized to chart mixing ratio trends. FIG. 6 illustrates a graph 100 illustrating a removal rate versus abrasive (solid content), in accordance with an alternative embodiment of the present invention. Finally, FIG. 7 depicts a graph 102 illustrating a removal rate versus mixing ratio, in accordance with an alternative embodiment of the present invention. Note that as indicated by abrasive/additive combination 104, a typical composition may be comprised of a 5% abrasive component, a 3% additive component, and a 91% DIW (i.e., dilution) component, along with a small percentage (i.e., greater than 1%) of proprietary components.

FIGS. 4 to 7 herein are not considered limiting features of the present invention, but merely present possible data that may be obtained through one possible implementation of the present invention. Those skilled in the art can thus appreciate that other types of data, including varying values and representations thereof can be obtained by practicing various embodiments of the present invention. This statement also holds true for the graphs 30, 40, 50, and 60 illustrated in FIG. 2.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is thus not intended to be exhaustive or to limit the scope of the invention. Many modifications and variations are possible in light of the above teaching without departing from scope of the following claims. It is contemplated that the use of the present invention can involve components having different characteristics. It is intended that the scope of the present invention be defined by the claims appended hereto, giving full cognizance to equivalents in all respects.

What is claimed is:

1. A method for monitoring a mixing ratio of a mixture utilized in a chemical mechanical polishing operation, said method comprising the steps of:

combining an abrasive component with an additive component to form a mixture thereof, wherein said mixture comprises a particular ultraviolet absorption spectra;

diluting said abrasive component and said additive component of said mixture; and thereafter analyzing said particular ultraviolet absorption spectra of said mixture, wherein said particular ultraviolet absorption spectra reflects a concentration of each component comprising said mixture, thereby providing data thereof indicative of said mixing ratio of said mixture utilized in said chemical mechanical polishing operation.

2. The method of claim 1 further comprising the steps of:

establishing a calibration curve based on a known mixing ratio mixture;

estimating a concentration of said abrasive component and said additive component from said calibration curve.

3. The method of claim 1 wherein said mixture comprises a slurry utilized in said chemical mechanical polishing operation.

4. The method of claim 1 wherein the step of combining an abrasive component with an additive component to form a mixture thereof, wherein said mixture comprises particular ultraviolet absorption spectra, further comprises the step of:

combining said abrasive component with said additive component in-line to form said mixture thereof.

5. A system for monitoring a mixing ratio of a mixture utilized in a chemical mechanical polishing operation, said system comprising:

an abrasive component combined with an additive component to form a mixture thereof, wherein said mixture comprises a particular ultraviolet absorption spectra;

a dilution component for subsequently diluting said abrasive component and said additive component of said mixture; and an analyzing mechanism for analyzing said particular ultraviolet absorption spectra of said mixture, wherein said particular ultraviolet absorption spectra reflects a concentration of each component comprising said mixture, thereby providing data thereof indicative of said mixing ratio of said mixture utilized in said chemical mechanical polishing operation.

6. The system of claim 5 further comprising:

a calibration curve established based on a known mixing ratio mixture;

an estimated concentration of said abrasive component and said additive component, wherein said estimated concentration is obtained from said calibration curve to thereby provide data indicative of said mixing ratio of said mixture.

7. The system of claim 5 wherein said mixture comprises a slurry utilized in said chemical mechanical polishing operation.

8. The system of claim 5 wherein said abrasive component is combined with said additive component in-line to form said mixture thereof.

* * * * *